United States Patent [19]

Angermann

[11] 4,139,929

[45] Feb. 20, 1979

[54] STRUCTURE FOR AN INTEGRATED DISPLAY AND BURIAL CONTAINMENT SYSTEM

[76] Inventor: Manfred E. Angermann, Geneva Oaks Rd., R. #5, Box 465, Lake Geneva, Wis. 53147

[21] Appl. No.: 785,320

[22] Filed: Apr. 7, 1977

[51] Int. Cl.[2] ..... A61G 17/00

[52] U.S. Cl. ..... 27/35

[58] Field of Search ..... 27/2–7, 27/35

[56] References Cited

U.S. PATENT DOCUMENTS

| | | | |
|---|---|---|---|
| 2,289,406 | 7/1942 | Beranek | 27/35 |
| 2,916,797 | 12/1959 | McCombs | 27/35 |
| 3,133,334 | 5/1964 | Johnsen | 27/35 X |
| 3,810,282 | 5/1974 | Doggett | 27/35 |
| 3,844,003 | 10/1974 | Angermann | 27/35 |

*Primary Examiner*—John D. Yasko

*Attorney, Agent, or Firm*—Wegner, Stellman, McCord, Wiles & Wood

[57] ABSTRACT

An integrated display and burial containment system utilizing a display container which may be removably mounted in a display unit for viewing and, thereafter, removed from the display unit and associated with additional structure, dependent upon ultimate disposition, such as ground burial, cremation or entombment in a mausoleum. For other than ground burial, the display container may have a cover unit associated therewith and for ground burial, a cover unit of a configuration similar to the first-mentioned cover unit, but of greater strength, is associated with a structural outer base in which the display container is positioned.

16 Claims, 9 Drawing Figures

STRUCTURE FOR AN INTEGRATED DISPLAY AND BURIAL CONTAINMENT SYSTEM

BACKGROUND OF THE INVENTION

This invention pertains to an integrated display and burial containment system having a group of structural components which duplicates the use of an expensive casket and a sealer vault but by means of relatively low-cost components.

Conventional funeral practice embodies the use of a casket for viewing which may be of varying cost and frequently quite expensive, followed by placement of the casket in a sealer vault for burial. The cost that goes into the sometimes ornate casket or, at least, the cost beyond the essential function of a casket to be a storage container is wasted, since the casket is buried.

One direction toward reducing cost is to have a tray or other similar structure removably mounted in a conventional casket and with the casket then being reusable. There could be problems, either real or imagined, with respect to continual re-use of a casket. An example of this type of structure is shown in Doggett U.S. Pat. No. 3,810,282.

Other structures to reduce cost include a casket of moldable plastic and also a combined casket and vault structure of plastic with an example of the latter being illustrated in Behrendt U.S. Pat. No. 3,295,179. These structures still involve unnecessary costs in attempting to make the unit look like a conventional casket and with the costs directed to such efforts not being recaptured, but being buried.

The prior activity in the field has not resulted in a low-cost, integrated display and burial containment system wherein the components of the system are designed of molded plastic construction and with no burial of a conventional casket-type structure.

SUMMARY OF THE INVENTION

A primary feature of the invention is to provide structural components resulting in an integrated display and burial containment system wherein relatively low-cost components can duplicate the use of an expensive casket and provide for various uses, such as mausoleums, cremation, or burial.

The components of the system include a display container for a body which may be temporarily staged in a beauitful and traditional display setting for viewing by the bereaved survivors by mounting in a display unit having parts thereof which may give a generally conventional type of casket appearance. Thereafter, the display container may be associated with alternately usable structure for final disposition. The additional structure includes a first cover unit which may be fitted onto the display container after removal from the display unit and with handle structure being optionally added to the display container to result in an enclosure for mausoleum storage or cremation. Alternatively, for burial, the display container may be positioned within a outer base and a second cover unit of the same configuration as the first cover unit but having greater strength may be sealed to the outer base, with the display container sealed therein.

In view of the foregoing, a primary object of the invention is to provide structure for an integrated display and burial system adaptable for cremation, ground burial or mausoleum entombment, including a display unit, a display container removably mounted in said display unit, a first cover unit for said display container after removal of the latter from the display unit to provide a closed container for mausoleum use or cremation, an outer base sized to receive the display container and a second cover unit of a greater strength than the first cover unit for said outer base, with associated means on the latter structure for sealing thereof for burial use and with the outer base and second cover unit forming a vault.

Another object of the invention is to provide an integrated display and burial system having many structural advantages and improvements including: the construction of both the first and second cover units from common or master molding of a plastic material molded on a male or female die and with the fully-molded common unit including a laterally-extending flange at the lower end of each depending wall as well as an additional flange depending from the laterally-extending flange to form the first cover unit, the second cover unit being formed by removal of said additional depending flange and the addition of strengthening wall material; the outer base has a perimeter trough-like structure including an outwardly-extending flange and an upstanding outer flange to receive the flange means on the cover unit and the display container as well as liquid bonding material or deformable plastic sealant for sealing the outer base and cover unit together and with the display container therein; the cover unit has a central dome with means surrounding the central dome defining a ledge and the outer base has a recessed bottom with a surrounding hood whereby viewing may be achieved by placing an outer base with a display container therein on top of the cover unit with the central dome positioned within the recessed bottom and the surrounding hood of the outer base resting on the ledge of the cover unit for secure placement.

An additional significant feature in achieving a low-cost system in the construction of the display container, the outer base and the cover units from molded plastic materials, with the parts having wall structure formed with an outward inclination to enable stacking of similar units for storage until required for use, and with a common unit being moldable for use as either the first cover unit or the second cover unit merely by deletion of a flange formed in the initial molding operation to make the second cover unit.

Despite the emphasis on low-cost plastic components, the resultant quality of funeral display is equal or superior to current traditional casket and vault displays. The plastic components lend themselves to airtight, waterproof containment not normally available in moderately priced funerals.

DESCRIPTION OF THE PREFERRED EMBODIMENTS

Figure 1:
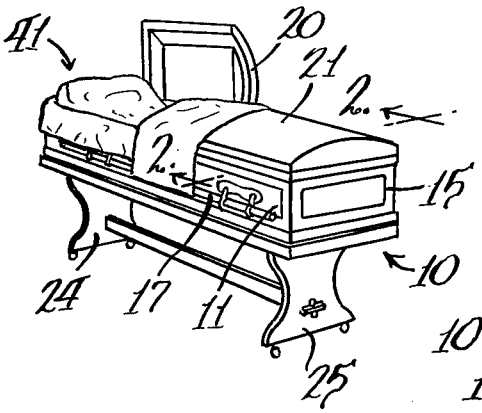
FIG. 1 is a perspective view of a display unit and display container arranged for viewing.
Figure 2:
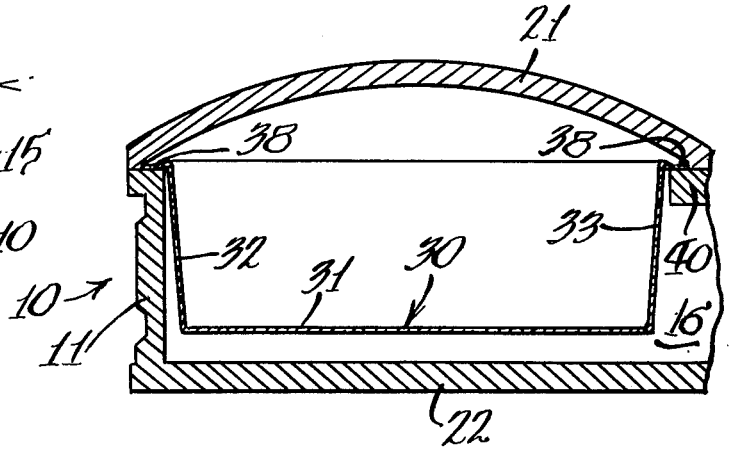
FIG. 2 is a fragmentary sectional view, on an enlarged scale taken generally along the line 2—2 in FIG. 1.
Figure 3:
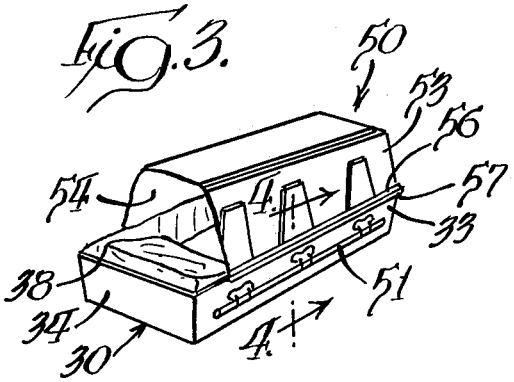
FIG. 3 is a perspective view of a cover unit and display container assembled for above-ground disposition and with the cover unit broken away.
Figure 4:
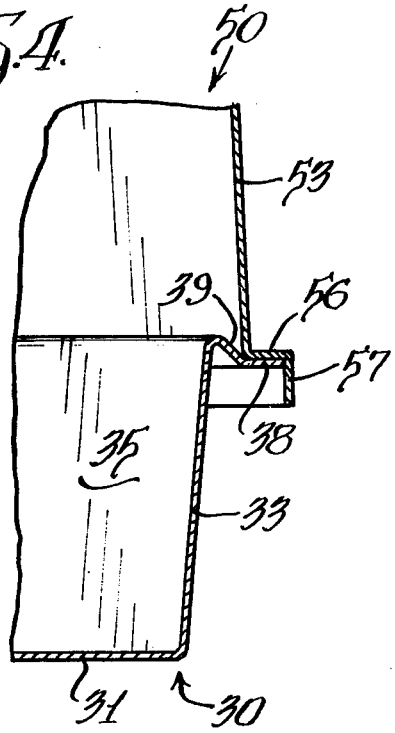
FIG. 4 is a fragmentary sectional view, on an enlarged scale taken generally along line 4—4 in FIG. 3.
Figure 7:
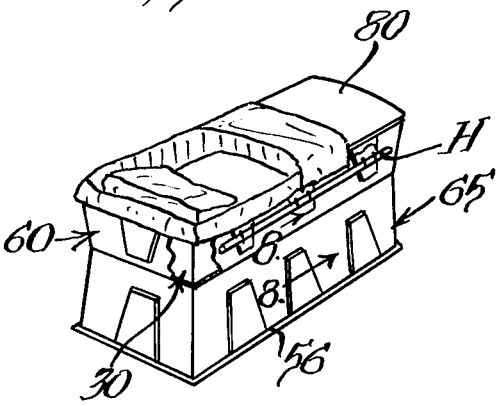
FIG. 7 is a perspective view of the components shown in FIG. 5 and with the cover unit forming a display base and with a part of the outer base broken away.

The integrated display and burial containment system provides for a viewing function as well as several different modes of ultimate disposition. The primary viewing modes are shown in FIGS. 1 and 7 and with two types of final disposition structure being illustrated in FIGS. 3 and 5. More specifically, FIG. 1 illustrates a display unit mounting a display container for viewing with the display unit having a basic appearance similar to a conventional casket and with the display unit being reusable. After removal of a display container from the display unit of FIG. 1, the display container has a cover unit associated therewith, as shown in FIG. 3, for above-ground disposition, such as mausoleum entombment or cremation.

Figure 5:
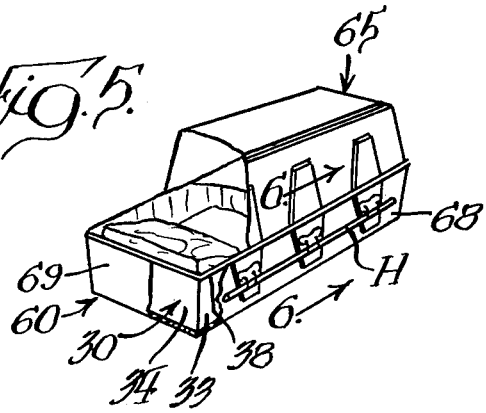
FIG. 5 is a perspective view of the display container in an outer base and with a cover unit ready for burial and with parts of the cover unit and outer base broken away.

In FIG. 7, a display container is associated with structure providing ultimately for burial, including an outer base which supports the display container and which is firmly mounted upon a cover unit forming a display base and, thereafter, being associated with the outer base in sealed relation for burial. This final relation is shown in FIG. 5.

More specifically, referring to the part of the system illustrated by FIGS. 1 to 4, the display unit, indicated generally at 10, has a front wall 11 and a pair of end walls 15 and 16 having a suitable appearance to generally resemble that of a casket to form a three-sided enclosure. A handle structure 17 and suitably mounted head and foot enclosures 20 and 21, respectively, are provided. A bottom panel 22 is supported from the floor by a base structure including interconnected panels 24 and 25 which have suitable means at the lower side thereof to provide portability for the display unit 10. The display unit 10 is open at the rear to permit insertion and withdrawal of a display container, indicated generally at 30.

The display container 30 has a bottom 31 with side walls 32 and 33 and end walls 34 and 35 upstanding from the bottom 31 and inclined outwardly to enable molding of the display container from a suitable material, such as a moldable thermoplastic or thermosetting material or composite laminate, and further to enable stacking of display containers 30 for storage prior to use. Each of the walls 32–35 has an outwardly-turned flange 38 which is set down slightly beneath the top of the display container by a downwardly-inclined interconnecting section 39. The outwardly-turned flanges 38 function as support flanges to support the display container 30 within the display unit 10, as shown particularly in FIG. 2. The support flanges 38 rest upon the top edges of the unit walls 11, 15 and 16, with the support flange 38 associated with the display container side wall 33 being supported upon a removable elongate bar 40 which is removably mounted to the interior of the display unit walls 15 and 16. This mounting may be by means of slots formed in the end walls 15 and 16 of the display unit which slidably receive the elongate bar 40, or by a temporary rear panel (not shown) which may be hingeably attached to the bottom panel 22. Suitable fasteners (not shown) may be used to prevent inadvertent movement of the elongate bar 40 and the bar may have suspended drape material to curtain off the rear.

The display container 30 has suitable trim of fabric or other material and a head support, indicated generally at 41 which are usable in viewing and which may be in part retained with the display container, after viewing, and with part being removable and not staying with the display container.

After viewing, with the system arranged as shown in FIG. 1, the display container 30 is removed from the rear of the display unit and a first cover unit, indicated generally at 50, may be placed over the display container 30. As shown in FIG. 3, the display container may have an optionally usable handle structure 51 which may be easily mounted to the side walls 32 and 33 with mechanical fasteners or adhesive. The cover unit 50 is shown particularly in FIG. 9 which illustrates the cross-sectional configuration thereof as molded of suitable material, such as a moldable thermoplastic, fiberglass or other thermosetting plastic or composite laminate, on a male or female die to thus have the basic molded structure be a common or master unit for both the first cover unit 50 as well as a second cover unit to be described. The cover unit 50 has a top with the major part thereof defining a dome 51 having means in the form of a surrounding flange 52 defining a ledge for a purpose to be described. A series of walls depend from the top of the cover unit including side walls 53 and 54 and a pair of end walls, one of which is identified at 55, and with an opposite end wall not being seen in the view of FIG. 3 wherein the cover unit is broken away. The depending walls of the cover unit each have a laterally-extending flange 56 of a width approximately equal to the width of the outwardly-turned supported flange 38 of the display container, for resting thereon as shown particularly in FIG. 4. Additionally, each of the wall flanges 56 has an additional flange 57 depending therefrom which extends downwardly past an outer edge of the outwardly-turned support flanges 38 of the display container for fitting and holding the cover unit 50 on the display container as viewed particularly in FIGS. 3 and 4.

Two relatively inexpensive plastic molded parts are all that is required for final disposition including the display container 30 and the first cover unit 50 and with the display unit 10 providing for conventional viewing.

The first cover unit 50 has the depending walls thereof inclined outwardly with respect to the top thereof which, again, enables pre-use storage of a number of the cover units in stacked relation for minimal space requirements.

For burial, the display container, after removal from the display unit 10 is associated with an outer base, indicated generally at 60, and a second cover unit, indicated generally at 65, in FIG. 5. The outer base 60 has a recessed bottom defined by a raised bottom panel 66 supported by an integral surrounding foot 67 and with upstanding walls inclined outwardly from the bottom including opposite side walls, one of which is identified at 68 in FIGS. 5 and 6, and with the opposite side wall not being seen. The foot 67 may be filled with a reinforcing material, such as rigid polyurethane foam or other suitable rigid supporting material. Additionally, there are end walls 69 and 69a. As with the display container 30 and the cover unit 50, the outer base is formed of a suitably molded structure of a moldable thermoplastic, fiberglass, or other thermosetting plastic or composite laminate and with the wall structure enabling stacking of a pluarlity of outer bases for storage. The outer base 60 may have or may not have handle means H which may be attached with mechanical fasteners or adhesive connections.

Figure 6:
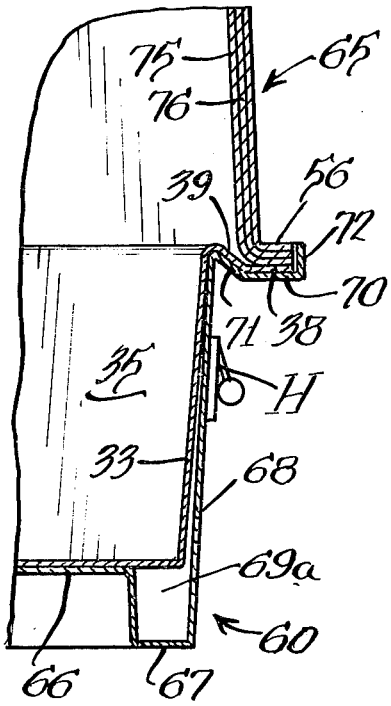
FIG. 6 is a fragmentary sectional view, on an enlarged scale, taken generally along the line 6—6 in FIG. 5.

As seen in FIGS. 5 and 6, the outer base is dimensioned to receive the display container 30 therein and with the outer base walls each having an outwardly-extending flange 70 set beneath the top level of the outer base by an inclined integral connecting section 71. Each of the outwardly-extending flanges 70 has an upturned outer flange 72 whereby the flanges 70 and 72 and the interconnecting section 71 form a trough. As shown particularly in FIG. 6, this trough receives and supports the outwardly-turned support flange 38 of the display container and also the second cover unit 65 and particularly the flange structure thereof, to be described. There is a space between the edge of the cover unit flange structure and the outer flange 72, whereby a liquid or deformable plastic sealant may be positioned in the trough and retained therein to effect a good sealing bond of the parts of the outer base 60, the display container 30 and the cover unit 65.

Figure 9:
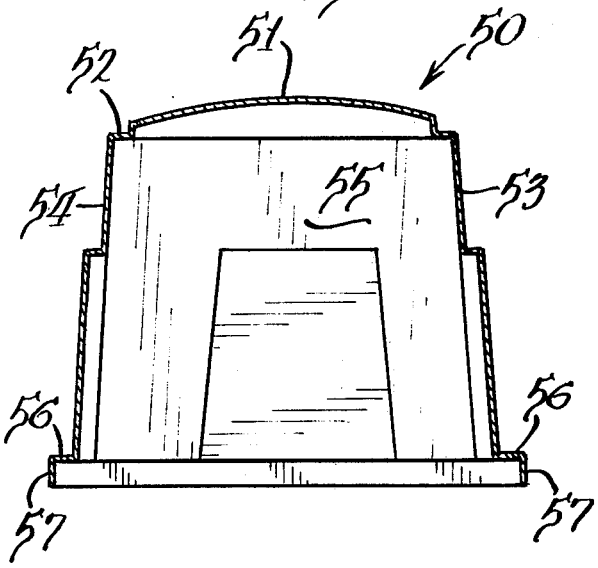
FIG. 9 is a transverse section of the cover unit shown in FIG. 3 on an enlarged scale.

The second cover unit 65, as mentioned previously, is formed from a common unit of the same basic shape as the first cover unit 50. Referring particularly to FIG. 9, the first cover unit 50 was described as having the depending flange 57 to coact with the display container 30. In forming the second cover unit 65, the depending flange 57 is omitted by severance from the laterally-extending flange 56 and since the second cover unit is used for burial, additional strength is obtained by constructing a laminated structure of differing plastic material bonded together to form a unitized cross section by adding a reinforcing wall structure to the interior thereof, as indicated by the wall layers 75 and 76 in FIG. 6 and with each additional wall layer having a laterally-extending flange underlying the laterally-extending flange 56 as seen in FIG. 6. Thus, the cover unit 65 when associated with the outer base and the display container, as viewed in FIG. 6, forms a strong burial vault structure and with the parts in sealed relation because of the good sealing imparted from use of the trough structure to hold the liquid or deformable plastic sealant as previously described.

Figure 8:
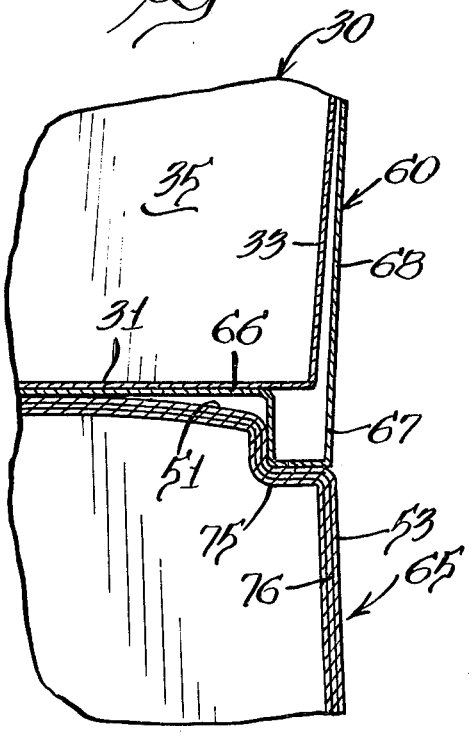
FIG. 8 is a fragmentary sectional view on an enlarged scale taken generally along the line 8—8 in FIG. 7.

For burial, there is an alternate display, as seen in FIGS. 7 and 8, and embodying the same components as described in connection with FIGS. 5 and 6.

In FIG. 7, the second cover unit 65 forms a display base, with the outer base 60 supported thereon and carrying the display container and with a foot panel 80 covering the foot section of the outer base and display container. The outer base 60 is supported on the second cover unit 65, in the manner shown particularly in FIG. 8 whereby the dome 51 of the cover fits into the recessed bottom of the outer base and with the surrounding foot 67 of the outer base supported on the ledge means 52 and engaging the perimeter of the dome for secure location of the outer base on the cover unit 65. After viewing, the cover unit 65 may then be associated with the display container 30 and the outer base 60 in the manner described in connection with FIGS. 5 and 6.

Form the foregoing, it will be evident that the structure disclosed herein provides an integrated display and burial containment system with a series of economically manufactured components which lend themselves to a variety of end use assemblies, provide concentrated stackable storage capability, and yet afford a traditional display setting for viewing. The low manufacturing cost of the components makes it possible to combine a traditional funeral setting and subsequent burial or other disposition of remains at a very modest cost.

I claim:

1. Structure for an integrated display and burial containment system adaptable for cremation, entombment, or interment including a display unit having a front wall and end walls and a rear opening, a display container mountable in said display unit and removable through the rear opening of the display unit, a first cover unit for said display container after removal of the latter from the display unit to provide a closed container for mausoleum use or cremation, an outer base sized to receive said display container, and a second cover unit of greater strength than the first cover unit for said outer base with associated means on the outer base and the second cover unit to enable sealing thereof for burial use.

2. A structure as defined in claim 1 wherein said display container has a bottom and upstanding walls to form a receptacle of a depth to receive a body and all of said walls being inclined outwardly to enable stacking of a plurality of said containers for pre-use storage and to facilitate placement of a body.

3. A structure as defined in claim 1 wherein each of said first and second cover units are of plastic materials and formed on the same mold to define a common unit having the same exterior configuration including a top and a plurality of depending walls, said walls having a laterally-extending flange at their lower ends, and said first cover unit having an additional flange depending from the laterally-extending flange which is removed from the common unit to form the second cover unit.

4. A structure as defined in claim 3 wherein said common unit has a top with a central dome and means defining a ledge surrounding said dome, and said outer base has a recessed bottom and a surrounding foot whereby the common unit may support said outer base for display with the dome within the recessed bottom and the surrounding foot engaging the dome and resting on the ledge.

5. A structure as defined in claim 1 wherein said display container has a bottom with upstanding walls each having an outwardly-turned support flange, and said first cover unit has a top with depending walls each having a laterally-extending flange to rest on said support flange and an additional flange depending from said laterally-extending flange to extend downwardly beyond said support flange and engage an outer edge of the support flange to locate and hold the first cover unit on the display container.

6. A structure as defined in claim 1 wherein said outer base has a bottom with upstanding walls and with an outwardly-extending flange at the top of each wall, said second cover unit having a top with depending walls each having a laterally-extending flange to rest on the outwardly-extending flanges of said outer base.

7. A structure as defined in claim 6 wherein the outwardly-extending flanges of the outer base have an outer flange extending upwardly therefrom to hold material which seals the second cover unit to the outer base.

8. A structure as defined in claim 1 wherein said outer base is of plastic materials and has a bottom with upstanding outwardly-inclined walls for stacking for storage, said display container is of plastic materials and has a bottom of a smaller perimeter than the outer base bottom and has upstanding outwardly-inclined walls for stacking for storage and to fit within an outer base.

9. An integrated display and burial system including a display unit having a front wall and end walls with a casket appearance and with an open rear, and a display container of plastic material having a bottom and upstanding walls inclined outwardly and with an outwardly-turned flange for support of the display container on the top of the display unit walls, cover means mountable on said flanges to enclose the display container for mausoleum use, and sealable base and cover means to receive said display container for burial use.

10. An integrated display and burial system including a display container removably-mounted in a display unit, said display container having upstanding walls with outwardly-turned flanges, and a cover unit mountable on the display container for mausoleum use, said cover unit having depending walls with each wall having a laterally-extending flange at the lower end thereof to rest on said outwardly-turned flanges and an additional flange depending from each laterally-extending flange to engage an outer edge of the outwardly-turned flanges and locate the cover unit on the display container.

11. An integrated display and burial containment system including a display container adapted for display independent of a conventional casket, said display container having upstanding walls each with an outwardly-turned flange, an outer base having upstanding walls with each wall having an outwardly-turned flange and the outer base being of a size to receive the display container and support the display container by engagement of said flanges, and a cover unit having depending walls each with a laterally-extending flange at the lower end to rest on said engaged flanges.

12. An integrated display and burial system as defined in claim 11 wherein the walls of said display container, said outer base and said cover unit are inclined outwardly for stacking of said parts for storage.

13. An integrated display and burial system as defined in claim 11 wherein the outwardly-turned flanges of the outer base have an upturned outer flange and are connected to the walls of the outer base to form a trough to receive a liquid or deformable plastic bonding material to seal said flanges together.

14. An integrated display and burial system including a display container and alternately usable structures dependent on mausoleum, burial or cremation use, said alternately usable structures including first and second cover units, both of said cover units having a basic plastic structure formed on a male mold including a top and depending walls with each wall having a laterally-extending flange at the lower end thereof functional in all uses of the system, and an integral additional flange depending from each laterally-extending flange for association with the display container for mausoleum use but removed when the cover unit is for burial use.

15. Structure for an integrated display and burial containment system adaptable for cremation, entombment, or interment including a display unit with rearwardly-opening access means and support means for a display container, a display container having a bottom with upwardly and outwardly inclined walls each having an outwardly-turned support flange at the upper end thereof for removable mounting within the display unit and support thereof by engagement of said support flanges with said support means, a first cover unit for said display container after removal of the latter from the display unit to provide a closed container for mausoleum use or cremation and having a top with depending walls each having a laterally-extending flange to rest on the adjacent support flange of the display container and an additional flange depending from said laterally-extending flange to extend downwardly beyond said support flange and engage an outer edge thereof to locate and hold the first cover unit on the display container, an outer base having a bottom with upstanding walls and an outwardly-extending flange at the top of each wall for receiving said display container for interment, and a second cover unit of greater strength than the first cover unit for association with said outer base and having a top with depending walls each having a laterally-extending flange to rest on the outwardly-extending flange of said outer base, said outwardly-extending flange of said outer base having an outer flange extending upwardly therefrom to form a trough to hold material which seals the second cover unit to the outer base.

16. Structure for an integrated display and burial containment system adaptable for cremation, entombment, or interment including a display unit with rearwardly-opening access means and support means for a display container, a display container having a bottom with upwardly-extending walls each having an outwardly-turned support flange for removable mounting within the display unit and support thereof by engagement of said support flanges with said support means, a first cover unit for said display container after removal of the latter from the display unit to provide a closed container for mausoleum use or cremation and having a top with depending walls each having a laterally-extending flange to rest on said support flange of the display container, and outer base having a bottom with upstanding walls and an outwardly-extending flange at the top of each wall for receiving said display container, and a second cover unit of greater strength than the first cover unit for association with said outer base and of the same configuration as the first cover unit including a laterally-extending flange to rest on the outwardly-extending flanges of said outer base, said outwardly-extending flanges of said outer base having an outer flange extending upwardly therefrom to hold material which seals the second cover unit to the outer base.

* * * * *